United States Patent [19]

Dawson

[11] 4,107,632

[45] Aug. 15, 1978

[54] ATTENUATOR ELEMENT

[75] Inventor: William P. Dawson, Indianapolis, Ind.

[73] Assignee: Texscan Corporation, Indianapolis, Ind.

[21] Appl. No.: 712,726

[22] Filed: Aug. 9, 1976

[51] Int. Cl.[2] ..... H01P 1/22

[52] U.S. Cl. ..... 333/81 A; 338/309

[58] Field of Search ..... 333/22 R, 70 CR, 81 R, 333/81 A; 338/306, 308, 309

[56] References Cited

U.S. PATENT DOCUMENTS

| | | | |
|---|---|---|---|
| 3,260,971 | 7/1966 | Bacher et al. | 333/81 A |
| 3,634,789 | 1/1972 | Stuckert | 333/81 A X |
| 3,676,807 | 7/1972 | Boer | 333/81 A |
| 3,740,676 | 6/1973 | Garuts | 333/81 A |
| 3,824,506 | 7/1974 | Bacher | 333/81A |

*Primary Examiner*—Paul L. Gensler

*Attorney, Agent, or Firm*—Woodard, Weikart, Emhardt & Naughton

[57] ABSTRACT

An attenuator element, for high frequency electrical signals, at a characteristic impedance such as 50 ohms. One or more distributed resistance regions are interposed between an input and an output and are coupled to a ground pad. The impedance of the distributed resistance portion or portions is higher than the desired 50 ohms and additional input and output resistances, nondistributed, are interposed between the input pad and the ground pad and between the output pad and the ground pad to bring the effective impedance at the input and output to the desired characteristic impedance level. Utilizing the nondistributed resistances at input and output increases the power capability of the attenuator element and also results in a larger size for the distributed resistance region or regions, providing less critical tolerances for producing the distributed resistance regions.

2 Claims, 2 Drawing Figures

ATTENUATOR ELEMENT

BACKGROUND OF THE INVENTION

1. Field of the Invention

The invention is in the field of high frequency attenuator elements.

2. Description of the Prior Art

In the past attenuator elements for high frequency applications have generally been of a distributed resistance type in order to obtain better frequency response than is possible with discrete resistance elements. Discrete resistance elements if used, are grouped in a pi or tee configuration to obtain the input and output characteristic impedance value desired, such as 50 or 75 ohms.

In the distributed resistance attenuator elements, one or more distributed resistance regions are coupled among input, output and common, and the bulk of the power dissipated in the attenuator element is dissipated in the first several thousandths of an inch of the distributed resistance portion adjacent the input. The power absorption in a distributed resistance element is a decreasing exponential curve from the input conductive pad side of the resistive element toward the output.

Since the power dissipation in the distributed resistance region is concentrated at the contact area with the input conductive pad, the power dissipation capability of the attenuator element is limited. Further, the overall size of the distributed resistance region is dictated by the particular characteristic impedance desired, often leading to rather small distributed resistance regions with difficult tolerances to maintain in order to arrive at the desired characteristic impedance.

SUMMARY OF THE INVENTION

One embodiment of the present invention is an attenuation element for high frequency electrical signals comprising a base portion, an input conductive pad and an output conductive pad on the base portion, a common conductive pad on the base portion, a distributed resistance region coupled between said input and output conductive pads and also coupled to said common conductive pad, an input resistance region coupled between the input pad and the common pad, and an output resistance region coupled between the output pad and the common pad.

It is an object of the present invention to provide an improved attenuator element having an increased power handling capability over that of traditional distributed resistance attenuator elements.

Further objects and advantages of the present invention shall be apparent from the following detailed description and accompanying figures.

DESCRIPTION OF THE PREFERRED EMBODIMENT

Figure 1:
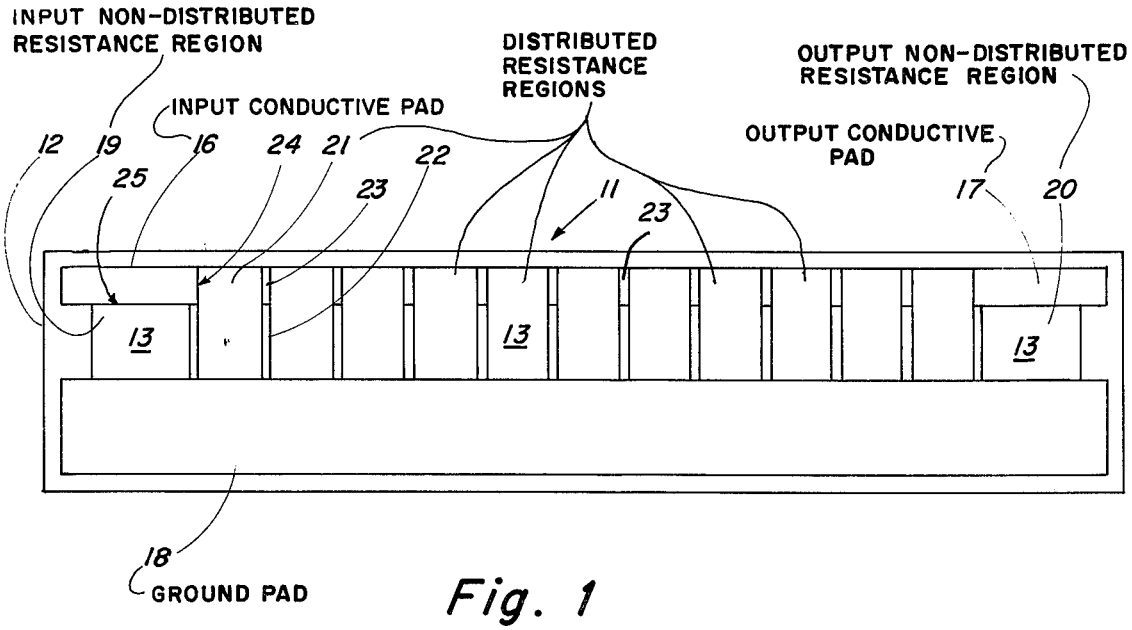
FIG. 1 is a top view of an attenuator element having two non-distributed resistance regions and a plurality of distributed resistance regions according to the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
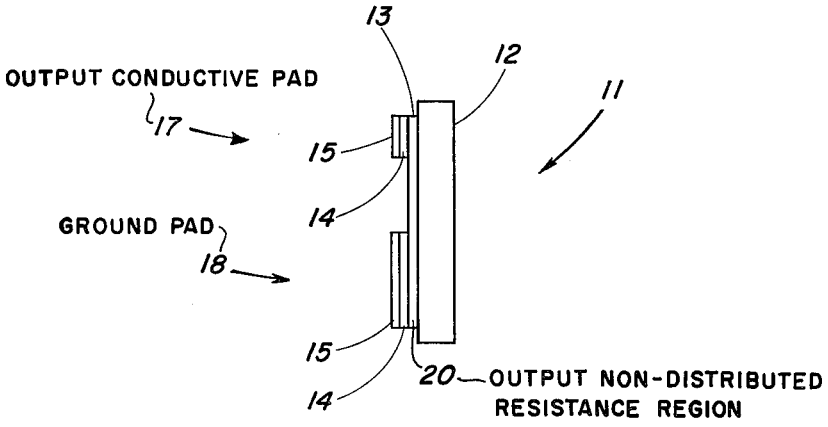
FIG. 2 is a side end view of the element of FIG. 1 taken from the right side of FIG. 1.

Referring now to FIGS. 1 and 2, there is shown an attenuator element 11 according to the present invention. Attenuator element 11 has in the exemplary embodiment an insulating alumina substrate 12 upon which there is a resistive film 13. Many other insulating substrate materials are possible, such as beryllia for high power applications. A nickel film 14 and a conductive gold film 15 are placed over resistive film 13 for the areas of conduction, or conductive pads. An input conductive pad 16 and an output conductive pad 17 are shown in FIG. 1 and comprise a nickel and gold layer 14 and 15 as indicated in FIG. 2. A ground, or common, conductive pad 18 is also located on substrate 12.

An input non-distributed resistance region 19 is connected between input pad 16 and ground pad 18. Similarly an output nondistributed resistance region 20 is located between output conductive pad 17 and ground pad 18. A series of distributed resistance regions such as 21 are located between input pad 16 and output pad 17. Each of these distributed resistance regions are spaced apart from one another as indicated at 22. As viewed in FIG. 1, the area indicated 22 would be visible substrate. Also between each distributed resistance region is a small conductive pad 23 to make electrical connection between the distributed resistance regions.

In a standard distributed resistance attenuator element, the majority of power dissipated in resistance element 21 would be concentrated at the interface between element 21 and input conductive pad 16 as shown generally at 24 and in the adjacent area of element 21. In the present apparatus, fixed, or non-distributed resistance 19 is provided, and a uniform current density exists from conductive pad 16 to common, or ground, pad 18. The current density is no greater at the interface, indicated at 25, than it is at other regions of resistance region 19.

Exemplary values for the attenuator element 11 are a 90 decibel attenuation from input pad 16 to output pad 17 with pad 18 common, a characteristic input and output impedance of the attenuator distributed resistances 21 of about 140 ohms, and nondistributed resistance regions from input and output pads to the ground pad having an impedance of about 78 ohms. These numbers yield a 90 db attenuator pad with an effective characteristic input and output impedance of 50 ohms (78 ohms//140 ohms).

As can be seen, the height, or longer dimension, of each attenuator distributed resistance region such as 21 would be considerably less if resistance regions 19 and 20 were omitted in order to obtain a 50 ohm characteristic impedance. Instead of a characteristic impedance of 140 ohms for the distributed resistance regions taken as a whole in the present device, in a standard distributed resistance construction, the impedance for the distributed resistance regions would be 50 ohms and the resistance regions would be considerably shorter in length. The shorter lengths provide a requirement for closer tolerances which is much less stringent with the larger impedance values obtainable when the shunt resistances 19 and 20 are used.

In the exemplary embodiment shown, approximately 64% of the power dissipated by element 11 is dissipated in the shunt resistances 19 and 20, primarily input fixed resistance 19. The distributed resistance regions such as 21 may be combined as a single distributed resistance region; the separated distributed resistance regions 21 are ordinarily utilized in order to improve frequency response of the attenuator element. Similarly, the spacing between, for example, undistributed resistance region 19 and distributed resistance region 21 may be eliminated. A second common pad may be employed by centering pads 16 and 17 on the regions 21 and extending resistance regions such as 19 and 20 upwardly. The added common pad would lie along the top of the attenuator element as viewed in FIG. 1. Of course, the resistance values would have to be revised for the desired characteristic impedance.

The element 11 may be provided with only an input resistance region 19 for applications where power dissipation improvement is desired but output matching is not critical. Similarly, regions 19 and 20 may both be provided but with different resistance values for matching to an input and an output of different impedance values.

While there have been described above the principles of this invention in connection with specific apparatus, it is to be clearly understood that this description is made only by way of example and not as a limitation in the scope of the invention.

What is claimed is:

1. A flat attenuation element for high frequency electrical signals comprising a flat insulating base portion, an input conductive pad and an output conductive pad on the base portion, a common conductive pad on the base portion, a distributed resistance region coupled between said input and output conductive pads and also coupled directly to said common conductive pad, an input resistance region coupled in shunt between the input pad and the common pad, and an output resistance region coupled in shunt between the output pad and the common pad, said flat attenuation element further comprising at least one more distributed resistance region coupled between said input and output conductive pads and also coupled to said common conductive pad.

2. The element of claim 1 in which the base portion is an alumina substrate and said resistance regions are a resistive film.

* * * * *